United States Patent [19]

LeBron et al.

[11] 4,083,321

[45] Apr. 11, 1978

[54] ANTI-PICKPOCKET WARNING DEVICE

[76] Inventors: Richard C. LeBron; Shelden P. LeBron, 6114 Country Club Rd., both of Omaha, Nebr. 68152

[21] Appl. No.: 721,687

[22] Filed: Sep. 9, 1976

[51] Int. Cl.[2] ..... A45C 13/18; G08B 13/00

[52] U.S. Cl. ..... 116/84; 2/DIG. 6; 150/47

[58] Field of Search ..... 116/84, 2, 77; 2/247, 2/DIG. 6; 150/47

[56] References Cited

U.S. PATENT DOCUMENTS

| | | | |
|---|---|---|---|
| 2,369,597 | 2/1945 | Miller | 150/47 |
| 2,693,164 | 11/1954 | Bruchlos | 116/84 |
| 3,009,235 | 11/1961 | De Mestral | 2/DIG. 6 |
| 3,144,894 | 8/1964 | Young | 150/47 |
| 3,374,508 | 3/1968 | Slimovitz | 150/47 X |
| 3,438,062 | 4/1969 | Dobell | 2/247 |
| 3,881,534 | 5/1975 | Gist | 150/47 X |

FOREIGN PATENT DOCUMENTS

| | | | |
|---|---|---|---|
| 28,835 | 12/1913 | United Kingdom | 116/84 |

*Primary Examiner*—Daniel M. Yasich
*Attorney, Agent, or Firm*—George R. Nimmer

[57] ABSTRACT

A first-strip of laminar material is securely attached to a wallet or analagous pocketable item for a wearing apparel garment, and a second-strip of laminar material is attached inside the garment pocket. The first and second strips of laminar material are removably adherent together whereby if a pickpocket attempts thievery of the wallet, a warning tug is coincidentally exerted against the wearer's garment. Preferably, the first and second strips are of the mechanically removably adherent hooks-and-eyes type which permits repeated effective removable adhesions and which also provides a supplemental audio signal to the garment wearer simultaneous with tugging wallet removal from the garment pocket.

4 Claims, 6 Drawing Figures

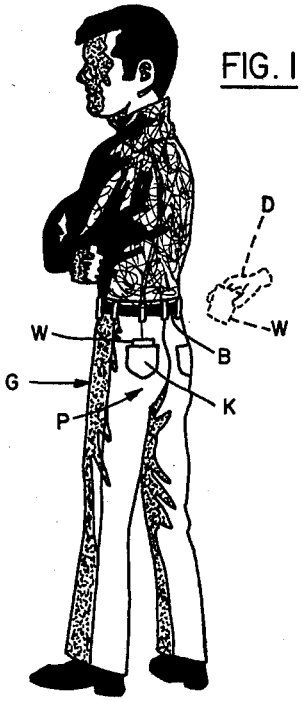
FIG. 1
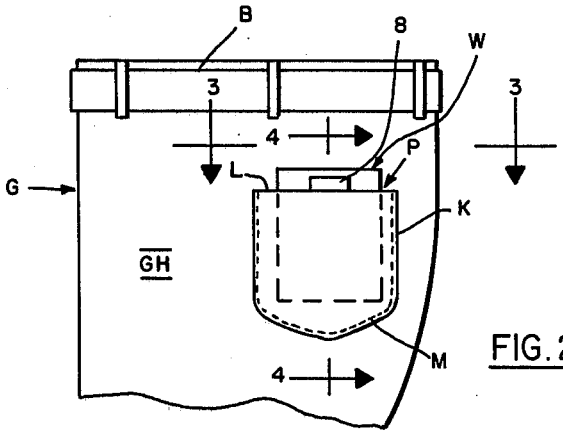
FIG. 2
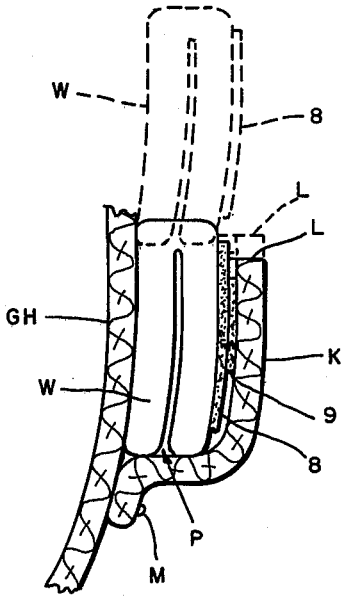
FIG. 4
FIG. 3
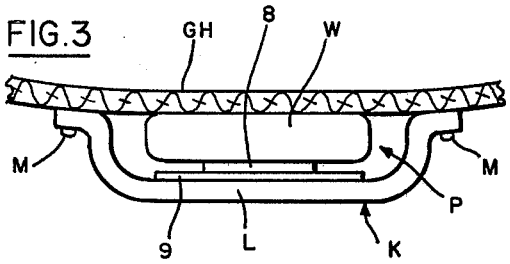
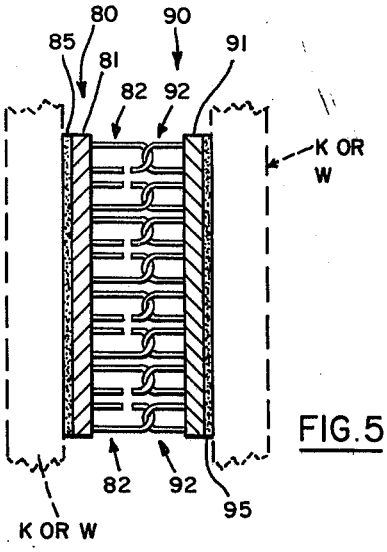
FIG. 5
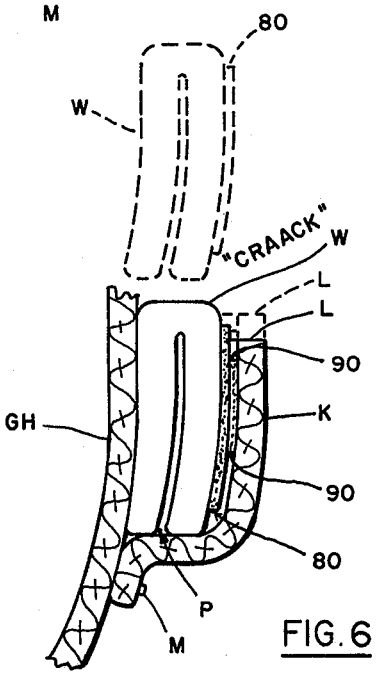
FIG. 6

ANTI-PICKPOCKET WARNING DEVICE

It is the general objective of the present invention to provide an anti-pickpocket warning device for a wallet or other garment pocketable item, whereby attempted theft thereof exerts one or more effective coincidental warnings to the garment wearer.

With this general objective, and other and further ancillary objectives and advantages in view, which will become more apparent as this description proceeds, the anti-pickpocket warning device of the present invention generally comprises: a first-strip of laminar material securely attached to the wallet or the like; a second-strip of laminar material securely attached inside a pocket of a donnable garment; and removable adhesion means extending from the first-strip to the second-strip whereby a warning tug is coincidentally exerted against the wearer's garment to indicate attempted pickpocket thievery. Preferably, the first and second laminar strips are of the mechanically removably adherent hooks-and-eyes type which permits repeated effective removable adhesions and which also provides to the garment wearer a supplemental audio warning during attempted pickpocket thievery.

In the drawing, wherein like characters refer to like parts in the several views, and in which:

FIG. 1 is a perspective view of a donned wearing apparel garment having a pocket which is conventionally supporting an inserted wallet, and indicating the anti-pickpocket warning concept of the present invention;

FIG. 2 is a detail view of FIG. 1;

FIG. 3 is a sectional plan view taken along line 3—3 of FIG. 2;

FIG. 4 is a sectional elevational view taken along line 4—4 of FIG. 2;

FIG. 5 is a sectional elevational view of an alternate and preferred mechanical removable adhesion means; and FIG. 6 is a sectional elevational view analagous to FIG. 4 and embodying the mechanical removable adhesion means of FIG. 5 and which provides a supplemental audio warning.

Initially referring to the typical pocket "P" structure of a wearing apparel garment e.g. trousers "G", of FIGS. 1–4 and 6. Trousers garment "G" has a conventional waist band or belt "B", and a large fabric area "GH" adjacent the wearer's posterior. Pockets such as "P" are conventionally defined by a pair of fabric upright-sides, such as "GH" herein for the inner-side located nearer the flesh and a more remote outer-side (e.g. patch "K") which has a non-vertical upper-lip terminus "L" which is usually horizontal. Herein, for the patch-style pocket, "K" is sewn to the garment at "GH" with stitching "M". A wallet "W" or other pocketable item may be supportably inserted into the garment pocket "P". As indicated in phantom line in FIG. 1, there is the danger that a pickpocket thief "D" might attempt thievery of the pocketed item e.g. "W".

FIGS. 2–4 clearly indicate one mode of the anti-pickpocket warning device of the present invention (e.g. 8, 9), which device 8–9 exerts a warning tug to the donned garment (e.g. "G") whenever the pocketed item (e.g. "W") is moved toward pocket upper-lip "L". To the pocketable item is securely attached a first-strip 8 of laminar material, which has an exposed broad outer-face remote of wallet "W". Into the pocket "P" a second-strip 9 of laminar material is securely attached and which has an exposed broad outer-frontage directly accessible to the first-strip outer-face carried at 8 by wallet item "W". Herein, second-strip 9 is attached to pocket outerside "K", rather than to pocket inner-side "GH", because of easier manipulation by and comfort to the garment wearer.

There are removable adhesion means extending from the first-strip (8) outer-face to the second-strip (9) outer-frontage, and in this regard strips 8 and 9 might each comprise a solid pressure-sensitive adhesive material. Thus, whenever the wallet item "W" is normally supportably inserted within the garment pocket "P", strips 8 and 9 removably adhere by physio-chemical means. Then, subsequent removal of the wallet "W" from pocket "P" exerts a tug to the garment "G", such as exhibited by upward and/or inward movements of the pocket upper-lip "L" (which tug is noticeable to the wearer of garment "G"). Accordingly, if a pickpocket "D" attempts thievery of the pocketed item "W", the garment wearer is notified by a forceable tug against his worn garment "G". Preferably, the first-strip 8 and the second-strip 9 are each of elongated rectangular shape, the second-strip 9 being substantially horizontally disposed and generally parallel to the pocket upper-lip "L". In this vein, the upright first-strip 8 substantially perpendicularly intersects the mid-area of the second-strip 9 when the pocketed item ("W") is in removably adhered pocketed position which facilitates authorized removal of the wallet "W" by the garment wearer. However, even during such authorized removal, there is some noticeable tug exerted to the donned garment.

The preferred type removable adhesion means between the laminar first-strip and the second-strip is of the mechanical hooks-and-eyes type such as described in the prior U.S. Pat. (Nos. 2,717,437; 2,933,797; and 3,009,235) to George deMestral. Such mechanical hooks-and-eyes type mechanical removably adherent means are sometimes currently known by the trade name "VELCRO", the mechanical adhesion principle thereof being schematically illustrated in FIG. 5. These, as generally described in the prior patents to deMestral typically comprise a hooks-strip 80 comprising a laminar backing 81 to which are attached a multitude of hooks 82 for random engagement with eyes array 92. The hooks-strip 80 is securely attachable to the pocketable item (e.g. "W") or to the inside of garment pocket "P" as with tenacious adhesive-bond 85. As also taught by deMestral, mechanical adhesion "V" means also typically comprises an eyes-strip 90 comprising a laminar backing 91 to which are attached a pile-form multitude of eyes 92. Eyes-strip 90 is securely attachable to the pocketable item or to the inside of the garment pocket as with a tenacious adhesive-bond 95 akin to 85. There are two especially noteworthy advantages for the mechanical removable adhesion 80, 90 as compared to the physio-chemical adhesion 8–9. First, the mechanical means 80–90 is not as apt to be fouled by lint or dirt as is adhesive 8–9. Second, the mechanical means 80–90 exerts a supplemental audio "CRACKING" signal to the garment wearer in addition to the garment tug whenever the item ("W") is being removed from a pocket ("P"). Thus, whenever a pickpocket "D" attempts thievery of wallet "W", the garment wearer is given two simultaneous warnings i.e. a forceable tug to his garment and an audible "CRACK" signal, whereupon the victim "G" can quickly confront the malfeasor "D".

From the foregoing, the construction and operation of the anti-pickpocket warning device will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

We claim:

1. In combination with a wallet uprightly removably inserted into a depending pocket of a donnable wearing apparel garment, which garment pocket comprises a pair of upright-sides including an upright inner-side located nearer the garment wearer and an upright outer-side generally parallel thereto and which pocket outer-side has an upper-lip terminus, the improvement of an anti-pickpocket warning device which exerts both a warning tug against and an audible signal whenever removal of the wallet is being made upwardly toward the pocket upper-lip, said warning device comprising:

A. An elongated substantially rectangular first-strip of laminar material adherently attached to the wallet and extending in the upright direction, said first-strip having an exposed broad outer-face;

B. An elongated substantially rectangular second-strip of laminar material adherently attached inside the pocket, said second-strip extending substantially horizontally directionally and being located below and substantially parallel to the pocket upper-lip, said elongated second-strip being crosswise the first-strip and having an exposed elongated outer-frontage that substantially perpendicularly intersects the mid-area of the first-strip at the outer-face thereof to facilitate wallet removal by the garment wearer; and C. Mechanical hooks-and-eyes type removable adhesion means extending from the first-strip outer-face to the second-strip outer-frontage so that whenever the pocketed wallet is manually actuated upwardly toward the pocket upper-lip both a physical tug and an audible signal are coincidentally exerted against the donned garment and audibly warning the garment wearer of unauthorized wallet removal.

2. The combination of claim 1 wherein the removable adhesion means of the audio signal type comprises a combination of randomly engageable hooks-and-eyes dual-laminae removable adhesion means.

3. The combination of claim 1 wherein the second-strip is secured to the pocket outer-side and substantially parallel to and below the pocket upper-lip.

4. The combination of claim 1 wherein the second-strip is horizontal and secured to the pocket inner-side and at an elevation below the pocket upper-lip.

* * * * *